United States Patent [19]

McGowan

[11] Patent Number: 4,712,697

[45] Date of Patent: Dec. 15, 1987

[54] LIGHTWEIGHT TOWER CRANE BOOM FOR CONVEYING PUMPED CONCRETE

[75] Inventor: Joseph L. McGowan, Harpenden, England

[73] Assignee: The Marley Cooling Tower Company, Mission, Kans.

[21] Appl. No.: 888,118

[22] Filed: Jul. 22, 1986

[51] Int. Cl.[4] ..... E04B 11/16

[52] U.S. Cl. ..... 212/189; 212/199; 212/224; 212/239; 212/266; 264/32

[58] Field of Search ..... 212/189, 199, 223, 224, 212/230, 232, 239, 242, 251, 266, 267, 271; 137/355.24, 615; 264/32

[56] References Cited

U.S. PATENT DOCUMENTS 4,505,397 3/1985 Isogai et al. ..... 212/251

FOREIGN PATENT DOCUMENTS 1516024 11/1966 France ..... 212/224

*Primary Examiner*—Jeffrey V. Nase
*Assistant Examiner*—Stephen P. Avila
*Attorney, Agent, or Firm*—Schmidt, Johnson, Hovey & Williams

[57] ABSTRACT

A lightweight boom supported by a rotatable jib of a tower crane for introducing flowable concrete mix to form systems has a concrete conveying conduit which functions also as a structural member of the boom, in order that the overall weight of the latter is minimized. The elongated boom has a triangular configuration in transverse cross-section, with two parallel, co-planar, spaced upper members and a hollow, concrete conveying bottom member that is generally parallel to the two upper members and spaced below the same. Horizontally extending brace members interconnect the two upper members, and spacer bars depending from the two upper members are secured to the bottom member. One aspect of the invention concerns a wheeled cart that is pivotally connected to an end portion of the boom and rests on ground level structure for supporting a portion of the weight of the boom while the jib lifts an opposite end portion of the boom to an elevated position, so that the weight and consequently the length of the boom can be increased without exceeding the carrying capacity of the tower crane. The boom is particularly adapted for tower cranes that are used to fabricate large annular concrete structures such as hyperbolic cooling towers.

5 Claims, 9 Drawing Figures

LIGHTWEIGHT TOWER CRANE BOOM FOR CONVEYING PUMPED CONCRETE

BACKGROUND OF THE INVENTION

1. Field of the Invention

This invention relates to a lightweight boom that is carried by a swingable jib of a tower crane adapted for use in the fabrication of annular structures such as concrete hyperbolic cooling towers. The elongated boom has a triangular configuration in a longitudinally transverse cross-section, and a bottom member representing one corner of the triangular configuration is in the form of a cylindrical pipe which has an internal fluid conduit for continuously conveying flowable concrete mix along the length of the boom for introduction into form systems on substantially a continuous basis as may be desired for construction of the tower structure.

2. Description of the Prior Art

For years, it has been common practice to fabricate large annular structures such as concrete hyperbolic cooling towers by use of a rotatable jib mounted on the top of a tower crane, wherein a winch line suspended by the jib successively lowers and raises a concrete mix bucket for conveying concrete from a mix plant or truck to successive locations along an annular form system. The bucket, which usually holds about two cubic yards of concrete, is raised by the winch and the jib is rotated through an arc while the bucket is also moved laterally to a position overlying a location on the forms so that the concrete can be deposited in the next area of the forms to be filled. As can be appreciated, considerable time is wasted during raising and lowering of the bucket, as well as moving the bucket along the length of the jib in such a batch-type operation, especially since as much as 600 cubic yards of concrete must be hoisted to the form system during each working day for the thicker parts of the shell, and since the bucket must be maneuvered about a number of reinforcing bars which project upwardly from the form system along the entire length of the latter.

A significant advance in the art of fabrication of annular concrete structures is taught by the disclosure of U.S. Pat. No. 4,374,790, dated Feb. 22, 1983 and owned by the assignee of the present invention. In U.S. Pat. No. 4,374,790, a method and apparatus is disclosed for continuously pumping flowable concrete mix to an elevated form system by use of a concrete conveying conduit carried by an elongated boom which is suspended by a jib and swingable therewith in an arc to continuously introduce the mix into the entire circumferential length of the form system defining the annular structure. The flow rate of the concrete is selectively controllable for advantageously filling the forms at a uniform, efficient rate without interruptions in the continuity of flow of the concrete mix.

The boom that is illustrated in U.S. Pat. No. 4,374,790 is supported by the jib by means of a primary hoist which is operable to raise and lower the boom, as well as a secondary, chain hoist which enables the boom to be tilted about a horizontal axis to selective vary the longitudinal orientation of the boom with respect to the horizontal. Moreover, the boom of this patent is preferably comprised of detachable sections which enables the length of the boom to be changed in accordance with the diameter of the next annular cooling tower segment to be poured. The boom disclosed in this reference has two parallel, spaced bottom members and a single upper member and presents a triangular configuration in longitudinally transverse cross-section; also, the concrete conveying conduit is carried by the two bottom members in underlying relationship thereto.

The tower crane shown in U.S. Pat. No. 4,374,790 comprises a plurality of stackable units which permits the height of the tower to be increased as necessary as the work progresses. Consequently, the boom of U.S. Pat. No. 4,374,790 can be shifted to a number of various positions so that an outlet spout flexibly connected to the concrete carrying conduit supported by the boom can be conveniently maneuvered along the form structure regardless of the height and diameter of the latter.

However, while the method and apparatus for pumping concrete to elevated form structures according to the disclosure of U.S. Pat. No. 4,374,790 clearly represents a breakthrough in the art, it is nevertheless desirable to provide a means for reducing the weight of the boom carried by the jib so that relatively large cooling towers can be constructed without resorting to the use of exceedingly large and heavy crane structures. In this regard, it has been suggested that the maximum practical length of the boom shown in U.S. Pat. No. 4,374,790 along with the concrete conveying conduit carried therebeneath be limited to approximately 150 feet, due to the relatively heavy structural members comprising the boom as well as the pipe for the concrete (having, for example, an outer diameter of 5.5 inches) and the volume of the concrete that is carried within the pipe at any one time.

SUMMARY OF THE INVENTION

In accordance with the present invention, a lightweight boom for support by a crane tower jib is provided wherein a concrete conveying pipe constitutes a structural, bottom member of the transversely triangular boom so that the weight of the latter is minimized in order to maximize the length of the boom. The boom may be, for example, 200 feet in length and yet weigh less than 150 foot boom and associated, separate concrete conveying pipe of the type shown in U.S. Pat. No. 4,374,790.

More particularly, the lightweight boom of the present invention has two elongated, upper members disposed in horizontally spaced, side-by-side parallel relationship, and a number of elongated brace members which extend horizontally at an angle to the upper members fixedly interconnect both of the upper members at spaced locations along the lengths of the latter. An elongated bottom member comprising a pipe with a concrete conveying conduit therein is spaced below the two upper members in a vertical plane extending midway between the upper members and a plurality of elongated spacer bars depending from each of the upper members are secured to a top portion of the pipe. As such, the transverse configuration of the boom is triangular in cross-section with the concrete conveying pipe located at the bottom apex of the triangle.

Provision of the concrete conveying conduit or pipe as a structural member of the boom greatly reduces the overall weight of the latter by elimination of a structural component which otherwise would be used for carrying a pipe. Location of the pipe at the bottom of the boom of the present invention retains a maximum pumping efficiency by reducing the maximum height of conduit through which the concrete mix is to be directed. Additionally, since the boom is comprised of detachable sections and end sections have downwardly tapered upper members which enable the use of shorter, lighter, upright spacer bars, location of the concrete conveying pipe along the bottom chord of the triangular boom permits the pipe to have an essentially straight configuration without the need for tapered pipe couplings on the boom end sections which match the downward inclination of the upper boom components.

In accordance with one aspect of the invention, the inward end of the boom is mounted on a cart having wheels that rollingly engage a base of the tower, while the jib is connected to the radially outward end portion of the boom for carrying the latter and supporting the boom in an inclined position. As such, a portion of the weight of the boom is supported by the cart, thereby reducing the weight that is carried by the jib of the tower crane. Use of the cart is particularly advantageous during pouring of the lowermost portions of a large diameter hyperbolic cooling tower since additional sections can be joined to considerably extend the length of the boom without exceeding the load supporting capacity of the jib. Once the cooling tower has been formed to a certain height, sections of the boom may be detached and the boom reassembled to a smaller overall length which is sufficient for reaching the form system for constructing the reduced diameter, upper sections of the cooling tower, as the boom at its reduced length has a weight which safely falls within the load carrying capacity of the jib.

The boom is connected to the cart for swinging movment about a generally horizontal axis to enable the outboard end of the boom to be raised or lowered in accordance with the height of the form system, and to also permit the boom to be lowered to a horizontal position on the tower base for convenient removal or addition of boom sections. Moreover, the boom is pivotally coupled to the cart for swinging movement about an upright axis, so that the outboard end portion of the boom can be shifted to different locations along the length of the annular form system without changing the position of the cart relative to the tower base.

DETAILED DESCRIPTION OF THE DRAWINGS

Figure 1:
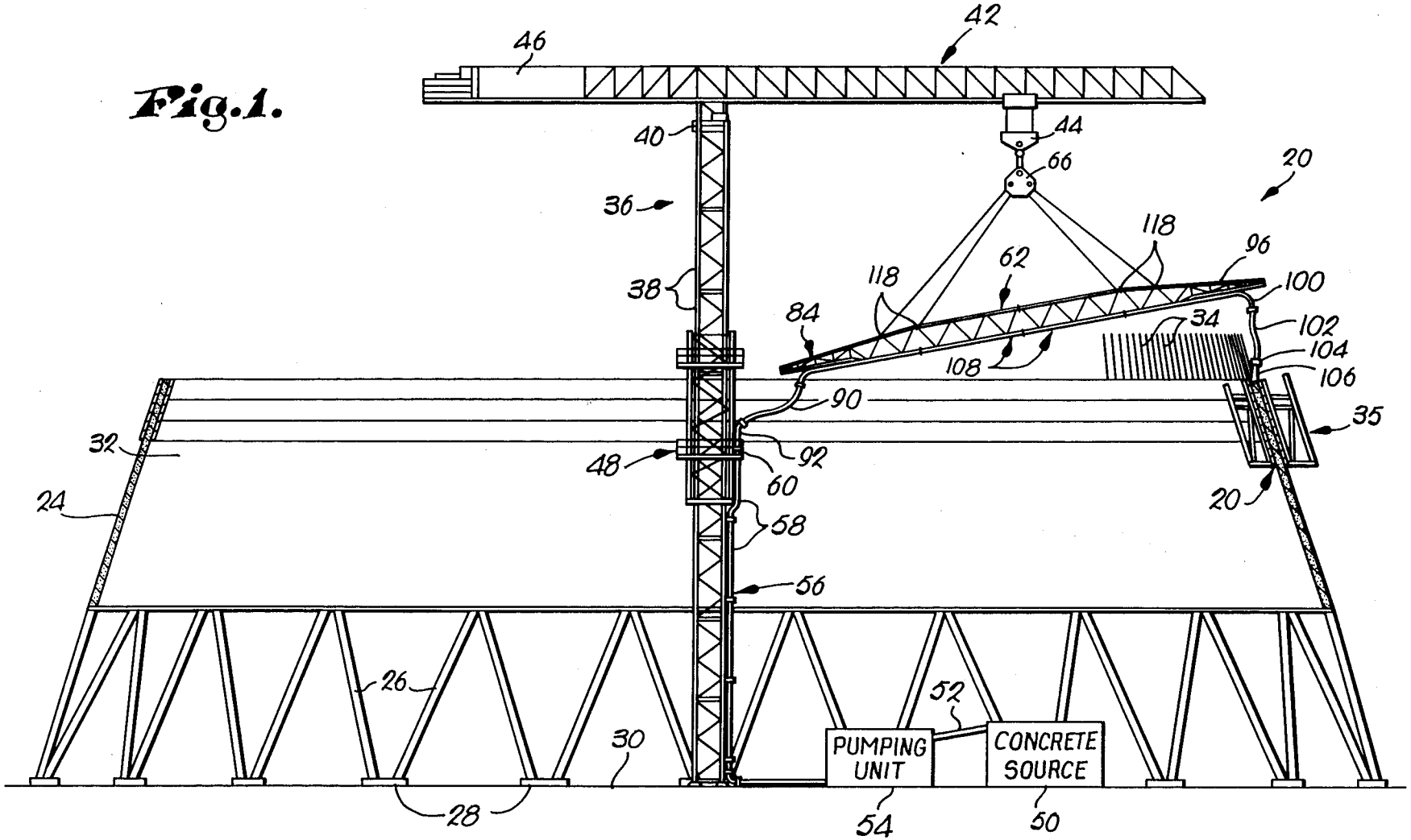
FIG. 1 is a side elevational view of the tower crane carrying the lightweight boom of the present invention, where the boom is shown for exemplary purposes in a position for construction of a concrete hyperbolic cooling tower.

Referring initially to FIG. 1, an apparatus 20 for continuously pumping flowable concrete mix to elevated heights is presented and is particularly adapted to introduce the mix into a form system 22 for fabricating an annular concrete structure such as a counterflow type hyperbolic cooling tower broadly designated 24. The tower 24 comprises inclined concrete support columns 26 which are carried by plinths 28 located at a ground level water collection basin or base 30. A concrete shell 32 is constructed by pouring a successive series of annular concrete sections which typically first decrease in diameter as the height of the shell 32 increases, then again become larger after the minimum diameter of a throat of the shell 32 has been formed. A number of upright steel reinforcing rods 34, along with circular horizontally extending reinforcing bars, strengthen the shell and transverse rods support opposite sides of the form system 22 while the concrete is poured and cured. Scaffolding 35 is associated with the form system 22 for supporting workers at a convenient height to raise the form system 22, install the reinforcing bars and rods, as well as to control placement and delivery of the concrete mix into the cavity presented by the form system 22.

The tower 24, as well as the apparatus 20 with the exception of the invention to be described hereinbelow, can be better understood by reference to the aforementioned U.S. Pat. No. 4,374,790 which is hereby expressly incorporated by reference into the present disclosure. The apparatus 20 includes a central tower crane 36 comprising a series of vertically stacked, box frame mast sections or units 38. A turntable 40 on the uppermost unit 38 rotatably supports a box frame jib 42 having a primary hoist 44 shiftable along the underside of a portion of the length of the jib 42, and a counterbalance 46 is disposed on an end section of the jib 42 remote from the hoist 44. A conventional climbing cage 48 permits additional mast units 38 to be inserted into the tower crane 36, thereby selectively raising the height of the jib 42 as may be desired.

Concrete mix, for introduction into the form system 22 to successively fabricate annular sections comprising the concrete shell 32, is supplied from a concrete source 50 that is shown schematically in FIG. 1 and which could take the form of a portable mix plant or the like adjacent the construction site, or alternatively could take the form of a vessel for temporarily holding concrete mix that is prepared at a remote site. The concrete source 50 is connected to an inlet pipe 52 of a concrete mix pumping means or pumping unit 54 which optionally may be of the type disclosed in more detail in U.S. Pat. No. 4,374,790. The pumping unit 54 also includes discharge piping 56 comprising a number of upright sections 58 secured to the tower crane units 38, and an offset, uppermost piping section 58 is connected to a rotary coupling 60 disposed adjacent the climbing cage 48.

A lightweight boom 62 is suspended by an elongated chain 64 which is trained through a secondary hoist or chain hoist 66 which is, in turn, carried by the primary hoist 44. The chain hoist 66 has sprockets which may be driven by a motor (not shown) in either a clockwise or counterclockwise direction, for tilting the boom 62 in a vertical plane about a horizontal axis to change the longitudinal orientation of the boom 62 with respect to the horizontal.

Figure 2:
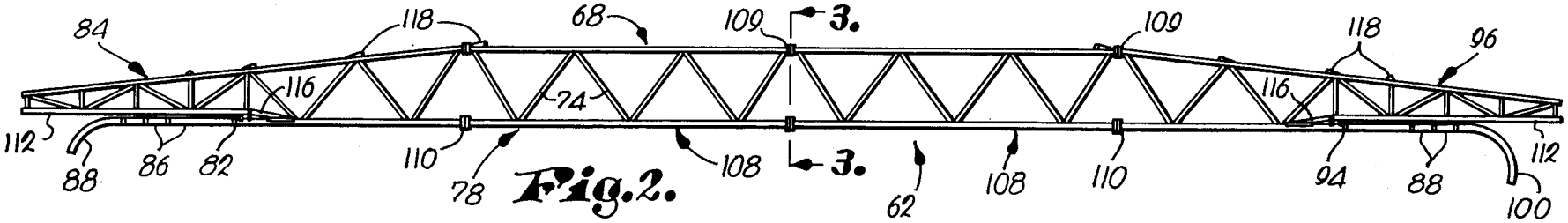
FIG. 2 is an enlarged, side elevational view of the lightweight boom shown in FIG. 1.
Figure 3:
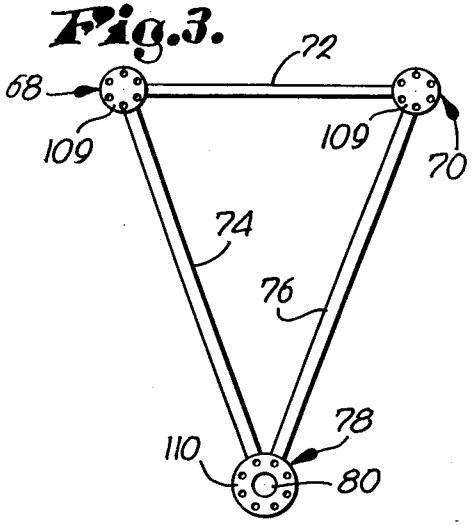
FIG. 3 is an enlarged, elevational view taken along line 3—3 of FIG. 2, with an adjacent end portion of the boom removed for clarity.
Figure 6:
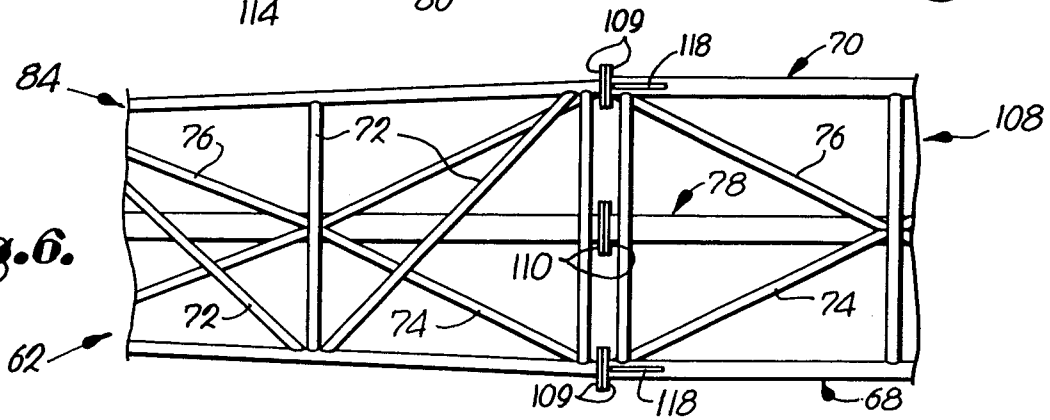
FIG. 6 is an enlarged, fragmentary, plan view of a portion of the boom shown in FIG. 2 where the boom begins to taper to a reduced cross-section, and depicting horizontally extending brace members which interconnect two upper members, as well as upright spacer bars which couple the upper members to the concrete conveying pipe forming a structural element in the lower element of the boom.

As illustrated in FIGS. 2, 3 and 6, the lightweight boom 62 comprises a first elongated upper member 68 and a second elongated upper member 70 disposed in horizontally spaced, side-by-side parallel relationship to the first upper member 68. A number of elongated brace members 72 each affixedly interconnect the first upper member 68 and the second upper member 70 at spaced locations along the lengths of the first and second members 68, 70. As shown best in FIG. 6, a portion of the brace members 72 extend horizontally between the members 68, 70 at a 90° angle to the longitudinal axes of the members 68, 70 while the remainder of the brace members 72 horizontally extend diagonally between the members 68, 70 with respect to the longitudinal axes of the latter.

Viewing FIGS. 2, 3 and 6, a first plurality of elongated spacer bars 74 each having an upper end portion secured to the first upper member 68 at spaced locations along the length of the latter. A second plurality of elongated spacer bars 76 each have an upper end portion that is affixed to the second upper member 70 at spaced locations along the length of the member 70.

An elongated bottom member 78 is disposed below the first upper member 68 and the second upper member 70 in spaced, generally parallel relationship to the members 68, 70 and lies in a vertical plane that is midway between vertical planes extending through the members 68, 70. As illustrated in FIGS. 2–4 and 6, each of the first plurality of spacer bars 74 as well as the second plurality of spacer bars 76 extend downwardly toward the bottom member 78 and each have a lower end portion that is fixedly connected to the bottom member 78. Opposite pairs of the bars 74, 76 converge toward each other, and in some instances extend in one direction toward bottom member 78, and in other instances extend in an opposite direction toward bottom member 78. The boom 62 presents a triangular configuration in a cross-section transverse to the longitudinal axis of the bottom member 78, and the triangular configuration is oriented such that two upper apexes (represented by the numbers 68, 70) lie in a common horizontal plane.

Figure 4:
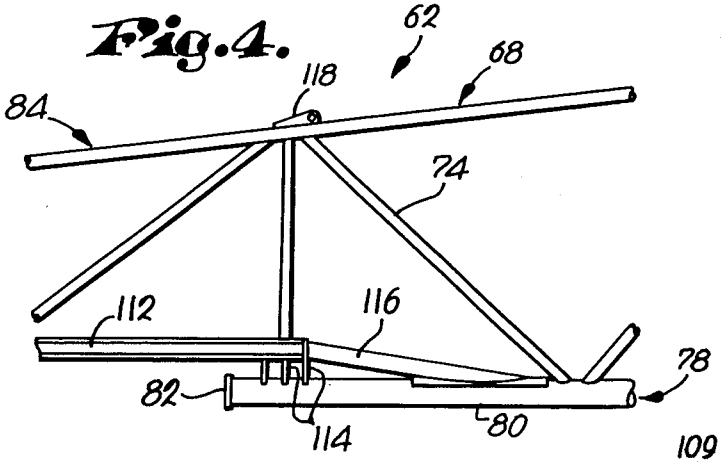
FIG. 4 is an enlarged, fragmentary, side elevational view of a boom end portion depicted in FIG. 2, particularly showing the concrete carrying pipe which forms a structural component of the major extent of the boom and which terminates in a port for connection to discharge piping of a concrete mix pumping unit.
Figure 5:
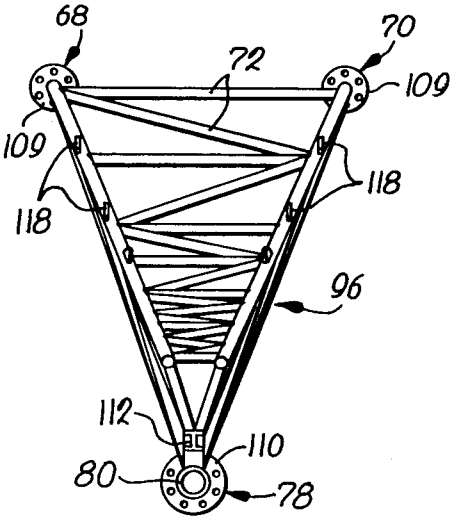
FIG. 5 is an enlarged, end elevational view of the boom taken along the righthand side of FIG. 2, with downstream pipe sections removed for clarity.

The bottom member 78 has walls defining a longitudinally extending, cylindrical, concrete conveying pipe or conduit 80 therein, as can be best appreciated by reference to FIGS. 3 and 5. Viewing FIGS. 2 and 4, the walls of the bottom member 78 defining the concrete conveying conduit 80 terminate in a port 82 that is located in a first end portion 84 of the boom 62.

A means for joining the concrete conveying conduit 80 to the discharge piping 56 of the pumping unit 54 includes straight pipe sections 86 (FIG. 2) coupled to the walls defining the port 82, and a curved pipe section 88 connected to the outermost straight section 86. As shown in FIG. 1, the curved pipe section 88 is coupled to a flexible hose 90 that is detachably secured to a swivel adaptor 92 which, in turn, is connected to the rotary coupling 60.

Turning again to FIG. 2, the walls of the bottom member 78 defining the conduit 80 terminate in a second port 94 that is located in a second end portion 96 of the boom 62 remote from the first end portion 84. The walls defining the port 94 are detachably secured to straight pipe sections 98 and a curved pipe section 100. As shown in FIG. 1, a flexible hose 102 is releasably fixed to the curved pipe section 100, and a rotary coupling 104 joins the hose 102 to a velocity reducing, elongated spout 106 which has a configuration of an inverted, truncated cone that is flattened to facilitate introduction of concrete mix to the space within the form system 22 around the reinforcing rods 34. Although not shown, a concrete mix discharge control gate may be provided at the lower end of the spout 106.

As can be appreciated, the elongated conduit 80 in the bottom member 78 is operable to direct concrete mix from the pumping unit 54 along the length of the boom 62 for introduction into the form system 22. Use of the bottom member 78 as a means for carrying concrete mix while serving as an integral, structural component of the boom 62 minimizes the weight of the latter and thus permits the overall length of the boom 62 to be maximized without exceeding the load carrying capacity of the jib 42 of tower crane 36.

Figure 7:
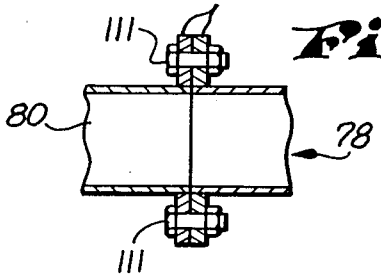
FIG. 7 is an enlarged, fragmentary, crosssectional view of one of a number of flanged pipe connections of the bottom, concrete conveying member between adjacent sections of the boom shown in FIG. 2.

The boom 62 is preferably formed of detachable sections, and for exemplary purposes in FIG. 2 two substantially identical, intermediate sections 108, 108 are releasably joined to boom end portions 84, 96. As perhaps shown best in FIGS. 3, 5 and 6, flanges 109 are secured to portions of the upper members 68, 70 along the length of both of the latter and have holes for receiving bolts for joining flanges of adjacent sections of the boom 62. Similarly flanges 110 (see also FIG. 7) are connected to portions of the bottom member 78 to releasably join sections of the boom 62 by means of bolts 111.

Referring to FIGS. 2 and 4–6, the upper members 68, 70 in the end portions 84, 96 of boom 62 converge toward each other and are inclined downwardly toward the bottom member 78 as either end of the boom 62 is approached. As such, the horizontally extending brace members 72 and the upright spacer bars 74, 76 are all reduced in length and thereby in weight as either end of the boom 62 is approached.

As illustrated in FIGS. 2 and 4, an I-beam 112 is located in each end portion 84, 96 and constitutes a bottom member for the remaining segments of the boom 62 outboard of the ports 82, 94 respectively. The I-beam 112 has a longitudinal axis parallel and above the longitudinal axis of the concrete conveying bottom member 78, and is coupled to the latter by three elements 114 (FIG. 4). An inclined, elongated pipe 116 is secured to the inboard end of each I-beam 112 and is also fixed to a portion of the concrete conveying bottom member 78.

Finally, lugs 118 fixed to upper members 68, 70 couple the chain 64 to the boom 62.

Good results have been observed when the horizontal length of the intermediate boom sections 108 is 30 feet, and when the upper members 68, 70 comprise 3 inch nominal pipe having an outer diameter of 3.5 inches, and the bottom concrete conveying member 78 is formed of 5 inch nominal pipe having an outer diameter of 5.5 inches. In such a case, brace members 72 can be formed of 1.5 inch nominal pipe (having an outer diameter of 1.90 inch) while the spacer bars 74, 76 constitute 2 inch nominal pipe having an outer diameter of 2.66 inches. The upper members 68, 70, are located on 5 foot centers, while the bottom member 78 is disposed a vertical distance of 7 feet below the upper member 68, 70. In this example, the end portions 84, 96 are of a length of 40.5 feet and the I-beams 112 are 4"×4". Also, the brace members 72 may be of a smaller diameter pipe outboard of each port 82, 94.

Figure 8:
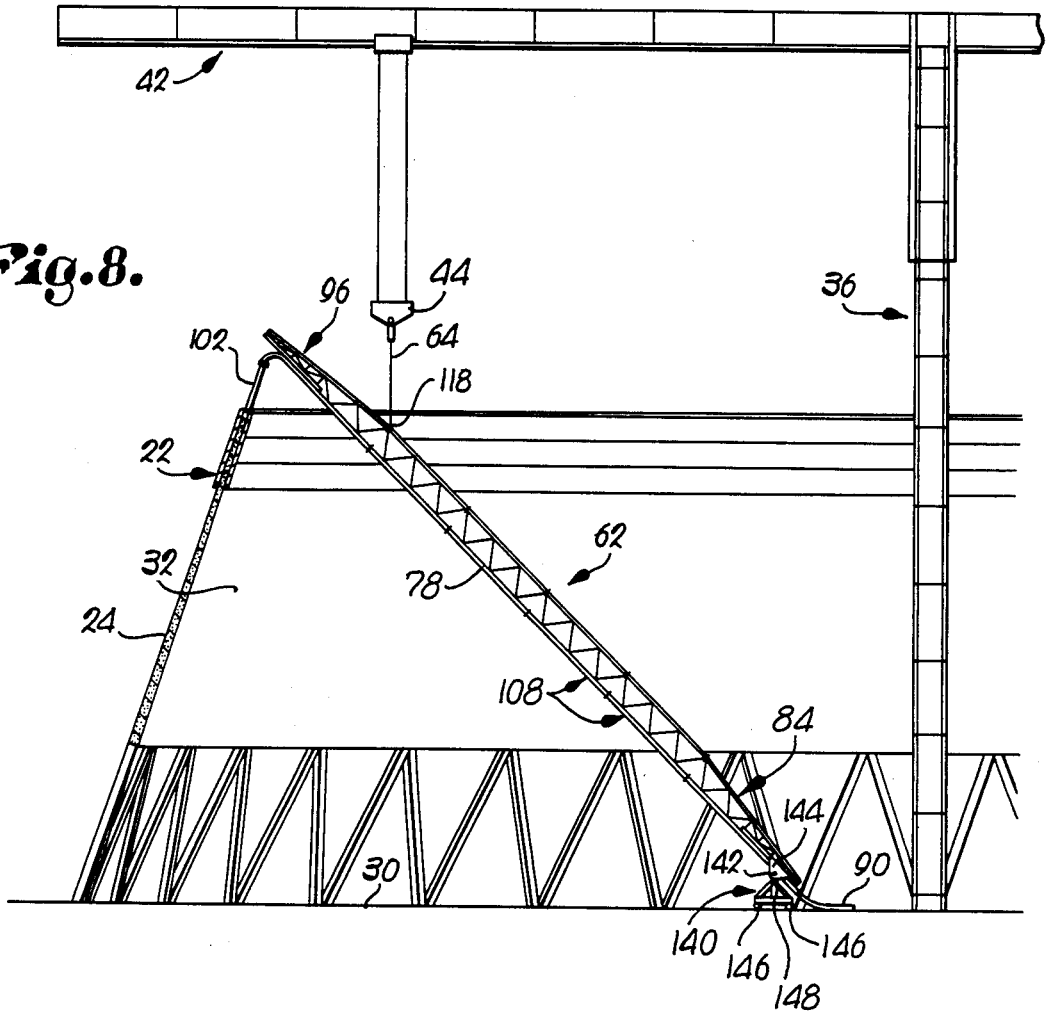
FIG. 8 is a fragmentary, side elevational view of the boom shown in FIG. 2 as utilized in connection with another embodiment of the invention, wherein an inboard or first end portion of the boom is supported by a wheeled cart and a jib rotatably carried by a crane tower supports an outboard or second end portion of the boom at an elevated position, such use being particularly advantageous for reducing the amount of boom weight that is carried by the jib.
Figure 9:
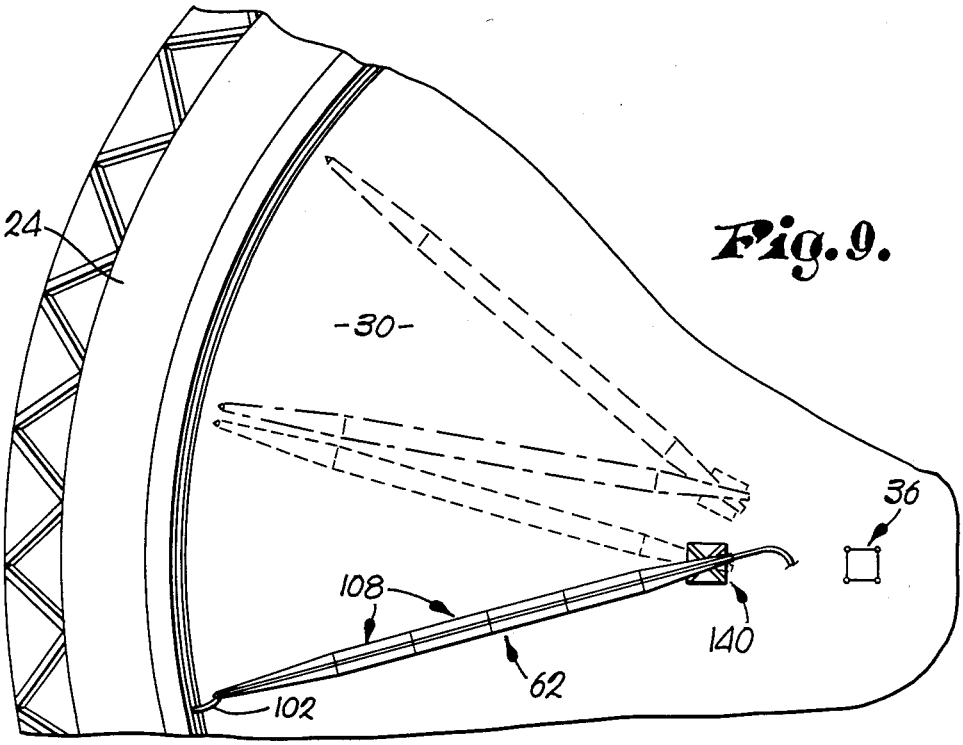
FIG. 9 is a fragmentary, plan view of the embodiment shown in FIG. 8, illustrating in broken lines for exemplary purposes some of the positions which the boom can assume when the cart is in a stationary position, or alternatively is moved laterally slightly to a second position, for enabling the concrete mix to be deposited at various points along the annular form structure.

One aspect of the invention is shown in FIGS. 8 and 9 and concerns a cart means or cart 140 which is pivotally coupled at 142 to a bracket 144 secured to the first end portion 84 of the boom 62. The cart 140 has four swivelable caster wheels 146 in rolling contact with the tower base 30 for carrying a portion of the weight of the boom 62 as the jib 42 supports the second end portion 96 of the boom 62 in elevated disposition relative to the first end portion 84 of the boom 62. As shown in FIG. 8, the chain 64 coupled to hoist 44 is connected to lugs 118 disposed on the second end portion 96 of boom 62.

An upright post 148 on the cart 140 is rotatably connected to the pivotal couple 142 which interconnects the bracket 144 and the cart 140. Consequently, the boom 62 is swingable in a vertical plane about a horizontal axis through the couple 142, and the boom 62 is also horizontally swingable about the upright axis of the post 148.

The caster wheels 146 are movable on the tower base 30 in directions radially of the cooling tower 24 as well as in an arc about the center of the tower 24 for adjustably positioning the concrete placement means, including the flexible hose 102, in a number of locations along the horizontal length of the annular form system 22. Referring to FIG. 9, it can be appreciated that the boom 62 can initially be positioned in the full line orientation as shown, and then swung about the upright axis of the post 148 without changing the position of the cart 140 relative to the tower base 30, in order to place concrete along a circumferential portion of the form system 22. Next, it is possible to move the cart 140 to the dashed line position, and the boom 62 is then swingable between the two upper dashed line orientations as shown. It is therefore possible to pour concrete mix into a substantial portion of the form system 22 before shifting of the cart 140 relative to the tower base 30 is necessary.

The pivotal couple 142 enables the primary hoist 44 to selectively raise the second boom end portion 96 as construction of the cooling tower 24 progresses and the form system 22 is advanced to higher elevations. Although in FIGS. 8 and 9 four intermediate boom sections 108 are illustrated for exemplary purposes, it is possible that fewer of the intermediate boom sections 108 could be utilized when the form system 22 is closer to the base 30 for forming the lowermost portions of cooling tower 24. It is also possible to lower hoist 44 to such an extent that the boom 62 is shifted about couple 142 to a generally horizontal orientation and fully supported by the tower base 30, so that the number of intermediate boom sections 108 can be modified and the length of the boom 62 thereby changed to facilitate placement of the concrete mix into the form system 22. The flexible nature of the hose 90 facilitates movement of the cart 140 relative to the base 30.

As a result, use of the cart 140 as shown in FIGS. 8 and 9 allows the length and consequently the weight of the boom 62 to be somewhat larger than would otherwise be possible, since the jib 42 supports only a portion of the weight of the boom 62 and remaining weight of the latter is carried instead by the tower base 30 via cart 140. Once fabrication of the tower shell 32 is completed to a certain height, the hoist 44 may be lowered to return the boom 62 to a horizontal configuration, whereupon one of the intermediate boom sections 108 can be removed and the boom 62 reassembled and subsequently fully carried by a jib in the manner illustrated in FIG. 1. Since the diameter of the cooling tower decreases as the throat is approached, the length of the boom 62 can be reduced at this stage of construction by eliminating one or more of the intermediate boom sections 108, to thereafter render the weight of the boom 62 to a value which can be safely supported by the jib 42.

In all forms of the invention, the concrete conveying conduit 80 of the bottom member 78 minimizes the weight of the boom 62 by elimination of a structural member that would otherwise be required. Moreover, orientation of the conduit 80 along the bottom of the boom 62 retains at a minimum the overall height to which the concrete mix must be pumped, thereby reducing energy costs as well as eliminating the weight of concrete which would otherwise be present within vertical sections of conduit.

I claim:

1. In an apparatus for lifting flowable concrete mix to an elevated height for introduction into a form system, wherein said apparatus includes a concrete pumping means having discharge piping, and crane means with an upright tower and an elongated jib carried by the tower and swingable about the upright axis of said tower, a lightweight boom at least partially supported by said jib for conveying concrete mix from said discharge piping of said concrete pumping means to said form system, said boom comprising:

a first elongated upper member, a second elongated upper member disposed in horizontally spaced, side-by-side, generally parallel relationship to said first member;

a number of elongated brace members each fixedly interconnecting said first upper member and said second upper member at spaced locations along the lengths of said first and second upper members;

a first plurality of elongated spacer bars each having an upper end portion secured to said first upper member at spaced locations along the length of the latter; a second plurality of elongated spacer bars each having an upper end portion fixed to said second upper member at spaced locations along the length of the latter;

an elongated bottom member disposed below said first upper member and said second upper member in spaced, generally parallel relationship to said first upper member and said second upper member, each of said first plurality of bars and each of said second plurality of bars extending downwardly toward said bottom member and having a lower end portion fixedly connected to said bottom member, said boom presenting a substantially triangular configuration in a cross-section transverse to the longitudinal axis of said bottom member, said bottom member having walls defining a longitudinally extending, concrete conveying conduit; and means for joining the conduit to said discharge piping of said pumping means to permit concrete mix from said pumping means to be directed along the length of said boom for introduction into said form system, said boom and thereby the conduit therein being of extensible length to enable concrete mix to be directed to said form system at selectively variable distances from the center of said tower.

2. The invention of claim 1, wherein said boom has an end portion, and said walls in said bottom member defining said conduit terminate in a port in a location within said end portion of said boom, said bottom member having walls engageable with a cart to enable said cart to partially support the weight of said boom.

3. The invention of claim 1, wherein said means for joining the conduit to said discharge piping comprises a rotatable coupling for facilitating swinging movement of said jib about the upright axis of said tower.

4. An apparatus for lifting flowable concrete mix to an elevated height above a tower base for introduction into a form system for an annular tower structure, said apparatus comprising:

concrete mix pumping means including discharge piping;

crane means having an upright tower and an elongated jib swingable about the upright axis of said tower;

an elongated boom having a first end portion and a second end portion, said boom including walls defining a conduit means in communication with said discharge piping of said pumping means and extending between said first end portion and said second end portion of said boom;

concrete placement means in communication with said conduit means adjacent said second end portion of said boom for introducing concrete mix into said form system as said concrete mix is pumped by said pumping means through said discharge piping and said conduit means;

means adjustably interconnecting said second end portion of said boom and said jib for selectively supporting said second end portion of said boom in elevated disposition relative to said first end portion of said boom; and cart means connected to said first end portion of said boom and having wheel means in rolling contact with said tower base for carrying a portion of the weight of said boom as said jib supports said second end portion of said boom in elevated disposition relative to said first end portion of said boom, said cart means being movable on said tower base radially of said tower structure as well as in an arc about the center of said tower structure for adjustably positioning said concrete placement means in a number of locations along said form system, said first end portion of said boom being pivotally connected to said cart means for swinging movement about an upright axis to enable said second end portion of said boom to be shifted to different locations along said form system without changing the position of said cart means relative to said tower base.

5. The invention of claim 4, wherein said first end portion of said boom is pivotally connected to said cart means for swinging movement about a generally horizontal axis to enable said second end portion of said boom to be raised or lowered to any one of a number of elevations in accordance with the height of said form system.

* * * * *